US007325868B2

(12) United States Patent
West et al.

(10) Patent No.: US 7,325,868 B2
(45) Date of Patent: Feb. 5, 2008

(54) TOOL FOR PROVIDING SUPPORT TO THE HUMAN UPPER BODY WHEN HAVING TO LEAN OVER TO WORK

(76) Inventors: Steven D. West, 3742 E. Holmes Ave., Mesa, AZ (US) 85206; Cheryl A. West, 3742 E. Holmes Ave., Mesa, AZ (US) 85206

( * ) Notice: Subject to any disclaimer, the term of this patent is extended or adjusted under 35 U.S.C. 154(b) by 19 days.

(21) Appl. No.: 11/390,926

(22) Filed: Mar. 28, 2006

(65) Prior Publication Data

US 2007/0236053 A1 Oct. 11, 2007

(51) Int. Cl.

| | |
|---|---|
| ***A47C 1/00*** | (2006.01) |
| ***A47C 1/031*** | (2006.01) |
| ***A47C 9/00*** | (2006.01) |
| ***A47C 9/02*** | (2006.01) |
| ***A47C 7/54*** | (2006.01) |

(52) U.S. Cl. ..... 297/4; 297/411.23; 297/411.33; 297/411.35; 297/411.36; 297/411.37; 297/423.11; 297/423.12

(58) Field of Classification Search ..... 297/4, 297/411.23, 411.33, 411.35, 411.37, 423.12, 297/423.13

See application file for complete search history.

(56) References Cited

U.S. PATENT DOCUMENTS

| | | | | | |
|---|---|---|---|---|---|
| 326,185 | A * | 9/1885 | White | 297/411.37 X |
| 1,417,250 | A * | 5/1922 | Kelly | 297/4 X |
| 1,721,221 | A * | 7/1929 | Jauregui | 297/411.35 X |
| 3,063,752 | A * | 11/1962 | Moore | 297/411.36 X |
| 3,206,249 | A * | 9/1965 | Gateley | 297/411.23 |
| 3,312,477 | A * | 4/1967 | Dirksen | 297/4 X |
| 4,098,478 | A * | 7/1978 | Spitzke | 297/4 X |
| 4,101,163 | A * | 7/1978 | Morin | 297/4 X |
| 4,266,748 | A * | 5/1981 | Dalton | 297/4 X |
| 4,366,981 | A * | 1/1983 | Ziegler et al. | 297/4 X |
| 4,397,374 | A | 8/1983 | Rumage et al. | |
| 4,433,870 | A * | 2/1984 | Bairen et al. | 297/4 X |
| 4,565,409 | A * | 1/1986 | Hollonbeck et al. | 297/411.36 X |
| 4,618,029 | A | 10/1986 | Lowry | |
| 4,641,882 | A * | 2/1987 | Young | 297/4 X |
| 4,650,249 | A * | 3/1987 | Serber | 297/423.13 X |
| 4,653,808 | A * | 3/1987 | Opsvik | 297/423.11 |
| 4,727,958 | A | 3/1988 | Botello | |
| 4,925,197 | A | 5/1990 | Jones | |
| 5,295,728 | A * | 3/1994 | Schaevitz | 297/423.12 X |
| 5,490,716 | A * | 2/1996 | Naughton | 297/423.12 |

(Continued)

*Primary Examiner*—Rodney B. White
(74) *Attorney, Agent, or Firm*—Raymond M. Galasso; Galasso & Associates, LP

(57) ABSTRACT

A tool is provided for supporting the human upper body when having to lean over to work. The tool comprising a platform member for supporting the human upper body in a leaning position thereby reducing back muscle strain and fatigue; a cushioned pad secured to an upper surface of the platform member providing a cushioned interface between the human upper body and the platform; an omni-directional tilt and swivel member secured to a bottom surface of the platform member; an elongated telescopic height adjustment member comprising two or more elongated telescopic sections providing platform height adjustment, said sections being separable from one another so that sections may be removed or added as desired; one or more removable base members, the base member being removable to permit replacing the base member so as to accommodate base member configured for different floor or support conditions.

7 Claims, 4 Drawing Sheets

U.S. PATENT DOCUMENTS 5,673,966 A * 10/1997 Morton, Jr. ..... 297/4
5,927,797 A * 7/1999 Ferguson ..... 297/4
5,927,815 A * 7/1999 Nakamura et al. .. 297/411.33 X
5,954,248 A * 9/1999 Jasper ..... 297/4 X
6,062,638 A * 5/2000 Ferguson ..... 297/4
6,824,149 B1 11/2004 Whitlock et al.
6,893,097 B1 * 5/2005 Ebensperger et al. ..... 297/4 X
6,926,365 B2 8/2005 Bottoms
7,055,910 B2 * 6/2006 Wright ..... 297/411.35
7,070,241 B2 * 7/2006 Saulnier et al. ..... 297/423.12
2007/0007400 A1 * 1/2007 James ..... 297/423.12 X

* cited by examiner

TOOL FOR PROVIDING SUPPORT TO THE HUMAN UPPER BODY WHEN HAVING TO LEAN OVER TO WORK

FIELD OF THE DISCLOSURE

The disclosures made herein relate generally to the field of devices or tools designed to provide support to the upper body of anyone who needs to lean over at an uncomfortable angle to work, and more particularly to devices having an extensible telescopic height adjustment frame, padded upper body rest, and a variety of support feet, as well as the ability to tilt and swivel to adapt to a variety of positions, thereby providing upper body lean support to the user engaged in tasks requiring an uncomfortable leaning body position. The height and swivel positioning allowing for optimum positioning of the upper body lean support to optimally carry the upper body weight and reduce work related back muscle strain, and provide greater comfort to the worker in performing a task requiring an awkward leaning posture. Those who would benefit include but are not limited to skilled tradesmen such as mechanics, plumbers, construction workers, as well as anyone who needs to work in an uncomfortable body posture.

BACKGROUND

Mechanics, tradesmen and other workers who are required to work for extended times at uncomfortable leaning postures are very much aware of the strains and fatigue encountered in such work. In the case of an auto mechanic, the mechanic may need to lean over a side of an engine compartment to access areas requiring his attention. In maintaining a leaning position without support aid soon results in back muscle strain and pain as well as strain to the neck muscles. In certain cases an engine, transmission or the drive component may be removed from a vehicle and placed on the floor for rebuilding or repair. Working on such a task for an extended period in a crouched or leaning position without means of support is a strain on the legs and back.

When leaning over to work on certain large components or work pieces, it if sometimes necessary to find a way to lean or brace oneself on the component for body support to reach and perform the task. This is often undesirable as the leaning on the work piece can be uncomfortable or undesirable as the surfaces may have sharp protrusions, sharp edges and often in the case of machinery are covered in grease and dirt.

In another example, workers in the heating and ventilation equipment field often need to work over low height equipment such as fans, compressors, and air conditioning equipment. Often servicing or installing such equipment requires one to crouch or lean into an enclosure for an extended time. Such postures are uncomfortable and can lead to back strain and muscle fatigue.

As a further example, gardeners often need to work for an extended time leaning over to dig in the soil, to cultivate and to otherwise weed and care for plants. There is a need for a device which supports the upper body weight and reduce back strain associated with gardening.

As illustrated above, there is a need for a tool or device that is easily assembled and adjusted to a variety of heights, that is compact in size, that is easy to move and carry from location to location, that adapts to a variety of ground or floor support conditions, that is light weight and low cost.

U.S. Pat. No. 4,618,029 discloses an adjustable apparatus for assisting engine repair consisting of an extended deck, a ladder, and an extended U shaped base of a form resembling a swimming pool diving board with include a ladder. While apparently suitable for working over an engine compartment on an engine, a limitation of this lean support apparatus is its limited height adjustment, large U frame base and ladder making it unsuitable for gardening, and other tasks described above.

U.S. Pat. No. 4,727,958 disclose an automobile mechanic's body support having an H shaped frame and adjustable rests for upper body and leg supports. A limitation of this body support is the elevated design with the extended front H frame, making it unsuitable for work on HVAC equipment and lower height tasks such as gardening due to the limited elevation adjustment range and inability to move in close to the work due to interferences from the H frame.

U.S. Pat. No. 4,925,197 disclose a creeper assembly with a second body portion pivotally connected thereto. A limitation of the creeper assembly is that is does not provide a height adjustment, and again is relatively bulky in design.

Therefore, a lean support tool that is light in weight, that is easily assembled and adjusted to a variety of heights, that is compact in size, that is easy to move and carry from location to location, that adapts to a variety of ground or floor support conditions, and that is light weight and low cost, such a lean support tool would be useful and novel.

SUMMARY OF THE DISCLOSURE

Accordingly, embodiments of the inventive disclosures made herein comprise a tool for providing support to the upper human body when having to lean over to work. An upper body support tool in accordance with the inventive disclosures herein comprises at least three major components: A platform member for supporting the upper portion or chest area of the human body, an elongated user adjustable telescopic height adjustment member, and a base member to receive the base member and to transfer the weight to the floor or support member on which the upper body support tool rests.

In an upper body support tool in accordance with the present inventive disclosure, the platform member is mounted to an upper end of the telescopic height adjust member by an omni-directional tilt and swivel means, the tilt and swivel means permitting the plane of the platform member to be angularly tilted relative to the telescopic height adjustment member to orient the platform to provide needed support to the upper body of the user. The swivel means permits the platform to be rotated about the tile swivel means mount point on the platform so as to permit alignment of the platform with the user's upper body position, and to swivel to follow the user's upper body position as the user performs the job or task at hand.

In an upper body support tool in accordance with the present inventive disclosure, the telescopic height adjust member comprises two or more telescopic sections that are slidably and supportively received into an adjacent telescopic section. A locking means is provided to lock the relative telescopic positions of the sections to one another. When it is desired to adjust the platform work height the telescopic sections may be unlocked, the telescopic height of the height adjustment member adjusted to place the upper body support platform at the desired work height, then the height fixed by retentively locking the height adjustment member at the desired height using the locking means.

The upper body support tool of the present inventive disclosures accepts a base member selected from a variety of base designs. Base members are of various designs adapted to stably interface with and transfer upper body support forces to the ground, floor or other environments on which the body support tool base rests. Base members include, but are not limited to, rectangular flat bases, tripod bases, and clamp on type bases as may be used, for example, to support the support body support tool on an axle.

The upper body support tool of the present inventive disclosures provides a swivel member at the mounting point between the bottom of the telescopic height adjustment member and the base member, the swivel member permitting the telescopic height adjustment member to be rotated around its axis relative to the base member, while the swivel member supportively prevents the height adjustment member from tilting relative to the base.

Turning now to specific embodiments of the inventive disclosures made herein, in at least one embodiment of the inventive disclosures made herein the tilt and swivel members on the base and at the platform can include a position locking means to retain to lock the angular alignment between the platform or base and the height adjustment member.

In at least one embodiment of the inventive disclosures made herein, the telescopic height adjustment member includes three or more telescopic sections, and the height adjustment member is configured to permit sections to be removed or added as needed. For example, more sections may be added to extend the height adjustment range of the height adjustment member. Additionally, sections can be replaced with sections of differing lengths, for example shorter height adjustment sections can be replaced with longer sections to change the height adjustment range of the height adjustment member.

In at least one embodiment of the inventive disclosures made herein, the upper body support tool is configured to be disassembled into smaller components for transport or to store between uses. In this embodiment the base, platform and height adjustment members are separable, and the height adjustment member may be disassembled into individual sections, or may be collapsed to the smallest size permitted by the lengths of the sections.

Accordingly, it is an objective of the inventive disclosures made herein to provide an upper body support tool that provides upper body support to anyone including mechanics, tradesmen and other workers who are required to work for extended times at uncomfortable body leaning positions.

It is another objective of the inventive disclosure made herein to provide an upper body support tool that transfers upper body weight forces from the back of the user and thereby results in a reduction of back muscle strain and pain, and permits the user to work in a more comfortable posture than if the user needed to hold the upper body in awkward leaning position using the back and leg muscles and an awkward and uncomfortable leg stance, including squatting.

It is still another objective of the inventive disclosure made herein to provide an upper body support tool that provides a variety of base members configured to work with various floor or ground compositions, as well as offering the ability to supportively clamp to other elements in the environment for support such as an axle.

It is yet another objective of the inventive disclosure made herein to provide an upper body support tool that is designed to break apart into components or disassemble to make the tool easier to transport and to store.

It is another objective of the inventive disclosure made herein to provide an upper body support tool having a swivel means provided at the base and a tilt and swivel means at the platform member so as to permit alignment of the platform with the user's upper body position, and to swivel to follow the user's upper body position as the user performs the job or task at hand.

These and other objects of the invention made herein will become readily apparent upon further review of the following specification and associated drawings.

BRIEF DESCRIPTION OF THE DRAWINGS

The drawings show a form of the invention that is presently preferred; however the invention is not limited to the precise arrangement shown in the drawings.

DETAILED DESCRIPTION OF THE DRAWINGS

In preparation for explaining the details of the present inventive disclosure, it is to be understood by the reader that the invention is not limited to the presented details of the construction, materials and construction details as illustrated in the accompanying drawings, as the invention concepts are clearly capable of other embodiments and of being practiced and realized in various ways by applying the disclosure presented herein.

Figure 1:
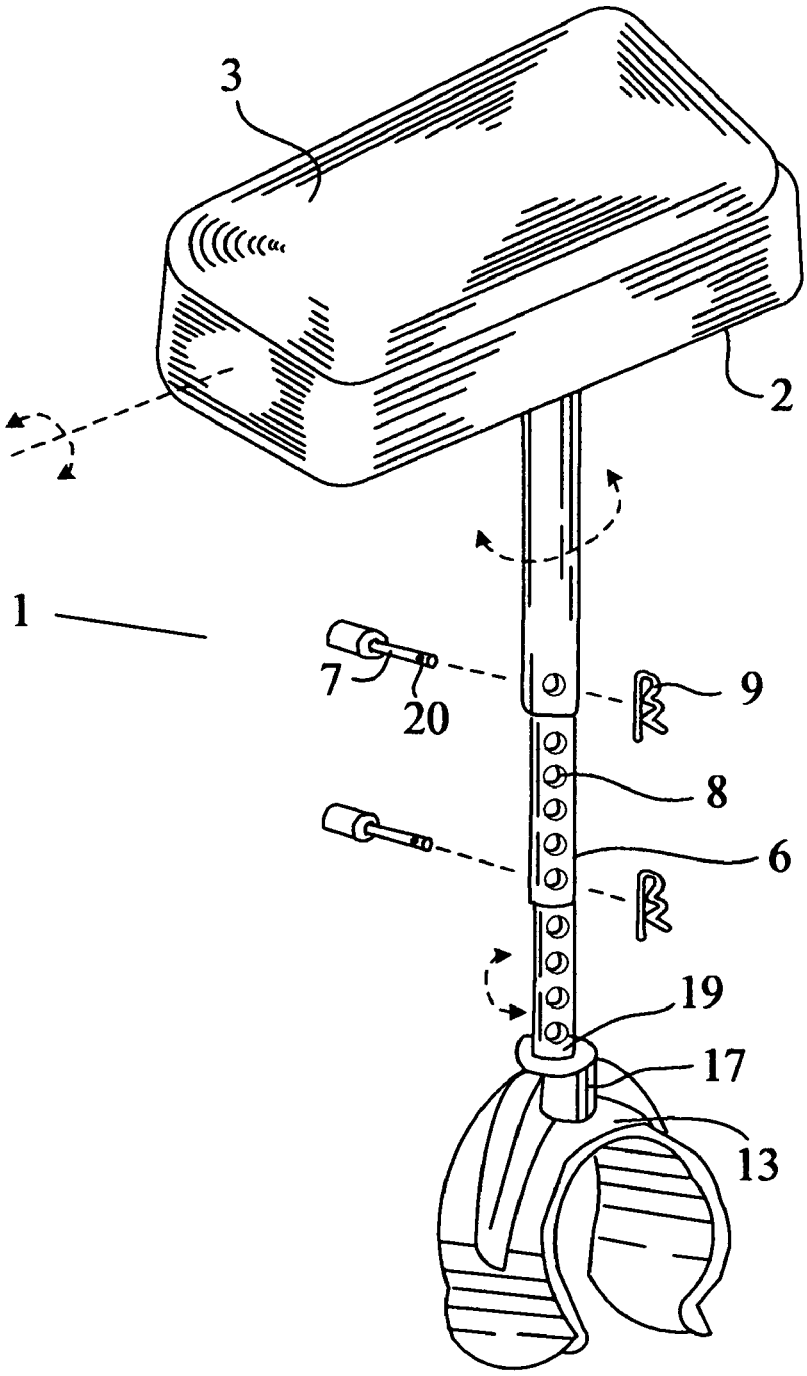
FIG. 1 presents a perspective view of one embodiment of the upper body support tool in accordance with the inventive disclosures herein.

FIG. 1 depicts one particular embodiment of the upper body support tool 1. The platform member 2 is provided and is sized to supportively span the width of a typical human upper body or torso. The top surface of the platform member is equipped with a cushioned pad 3 configured to provide a cushioned and comfortable interface between the upper body chest area and the platform member. An omni-directional tilt and swivel joint is secured to the bottom of the platform member. The swivel joint in this particular embodiment comprises a lower tilt and swivel member consisting of a ball, and an upper tilt and swivel member comprising a socket sized and configured to enclose portions of the ball while permitting the ball to swivel and rotate within the socket. The socket may include a friction stop or position locking member such as an adjustable collar to frictionally hold or lock the position of the ball in socket. Other types of tilt and swivel members as would be known to those skilled in the art may be substituted without deviating from the design intent of this inventive disclosure. In the depicted embodiment, the telescopic height adjustment member comprises a total of three tubular sections 6. The sections 6 are sized and configured such that the outside diameter of a section is somewhat smaller than the inside diameter of the section into which it is telescopically received. Each section is provided with pairs of holes 8, each section having a major axis along its length, each hole in a pair in facing alignment on opposing sides of the telescopic section such that each hole pair provides an opening or void completely through the telescopic section. The holes are spaced at regular intervals along the major axis of the telescopic section.

Holes 8 in the adjacent tubular telescopic sections 6 are similarly sized and spaced so that as one section is telescopically adjusted in the adjacent section, pairs of holes come into alignment at one or more telescopic positions so as to receive the latching pin 7 through the aligned holes. In the depicted embodiment the latching pin 7 supportively fixes the relative telescopic position of the sections, preventing further telescopic adjustment of the sections and providing the means by which the sections can transfer compressive forces from the platform to the base. By design the latching pin 7 is removable so as to allow for further telescopic height adjustment of the height adjust member 6. Once pin 7 is inserted to fix the relative positions of the telescopic sections, a pin retainer key 9 is inserted through a hole 20 through the sidewalls of pin 7 at the insertion end of the pin, the pin retainer key thereby preventing the latching pin from becoming dislodged and releasing the telescopic sections to telescopically adjust.

The latching pin 7 may be replaced by a spring pin, wherein ends of the spring pin extend outwards through the aligned holes of the inner telescopic section. The spring pin has a spring sized to be compressible under the applied force of the human hand. The spring pin extends through the aligned holes in the telescopic sections and thereby fixes the relative position of the sections. When the spring pin is compressed the pin retracts into the inner telescopic section, releasing the outer telescopic section thereby permitting the sections to telescopically adjust relative to each other.

The lower end of the telescopic height adjustment member is pivotally coupled to the base member 13 through the swivel coupling member 12. The swivel coupling member allowing the height adjustment member to be rotated in the coupling member while preventing the height adjustment member from tilting or changing its angular relationship to the base member. In at least one embodiment the swivel coupling member comprises a socket assembly having a socket 17 secured to an upper surface of the base member, and a shaft member 19 secured to the lower portion of the height adjustment member, the shaft member sized and configured to be rotationally and supportively received into the socket, the socket assembly allowing the height adjustment member to rotate about the major axis of the height adjustment sections relative to the base member, the socket assembly supportively preventing the height adjustment member from angularly tilting relative to the base member. Other types of swivel coupling member as would be known to those skilled in the art may be substituted without deviating from the design intent of this inventive disclosure.

As discussed above, the upper body support tool can be equipped with a variety of support base designs. FIG. 1 depicts on base member embodiment, particularly the axle mount base member 13. Axle mount base member 13 is configured to receive and rest upon an axle, shaft or other support arm member, providing a means of support to the platform by transferring compressive forces from the weight of the upper body to the axle.

Figure 2:
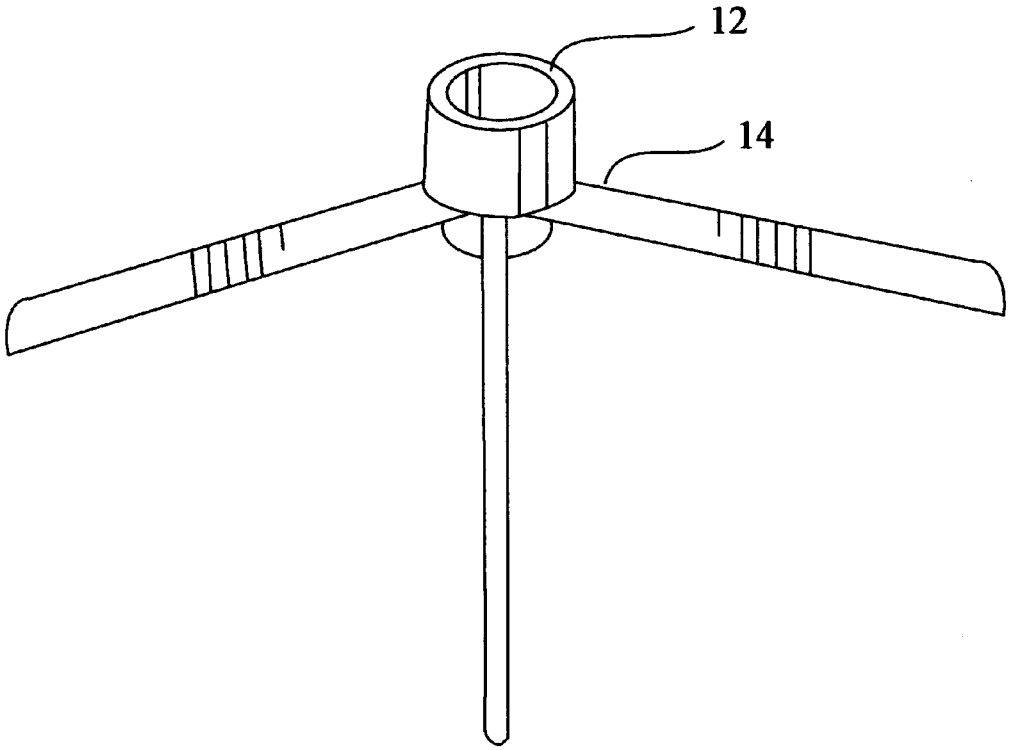
FIG. 2 is a perspective view of a tripod style base for the upper body support tool in accordance with the inventive disclosures herein.

FIG. 2 depicts another particular embodiment of a base member of the upper body support tool. FIG. 2 depicts a tripod style base member 14 having a swivel member 12 at its center to receive the bottom portion of the height adjustment member, as described earlier in the swivel member discussion of FIG. 1.

Figure 3:
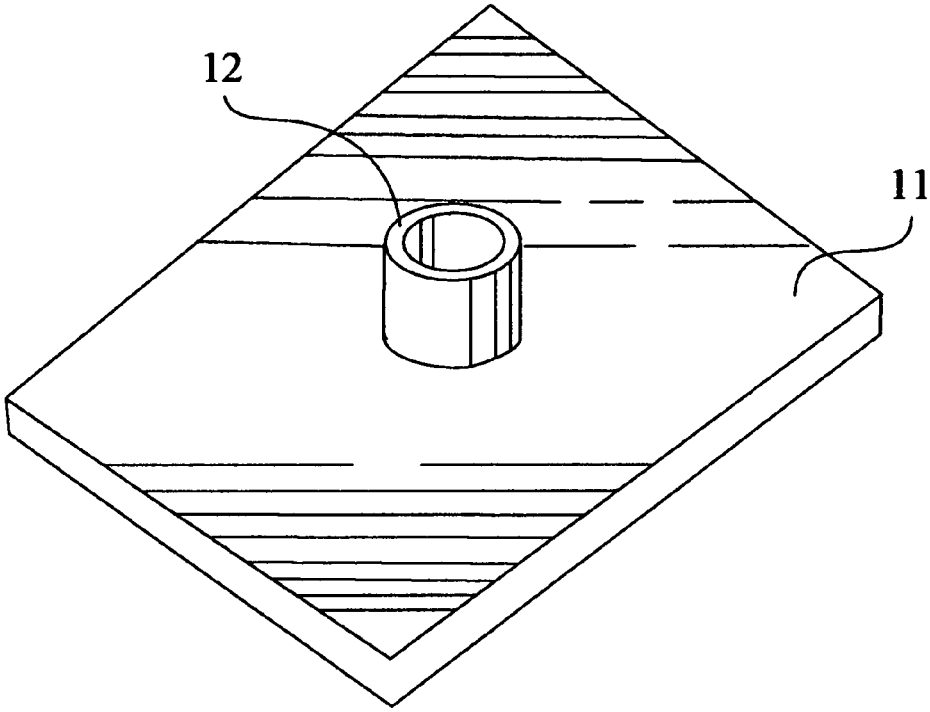
FIG. 3. is a perspective view of a flat base for the upper body support tool in accordance with the inventive disclosures herein.

FIG. 3 depicts another particular embodiment of the base member 11, in particular a substantially flat relatively rectangular base having a swivel member 12 at its center to receive the bottom portion of the height adjustment member, as described earlier in the swivel member discussion of FIG. 1.

Figure 4:
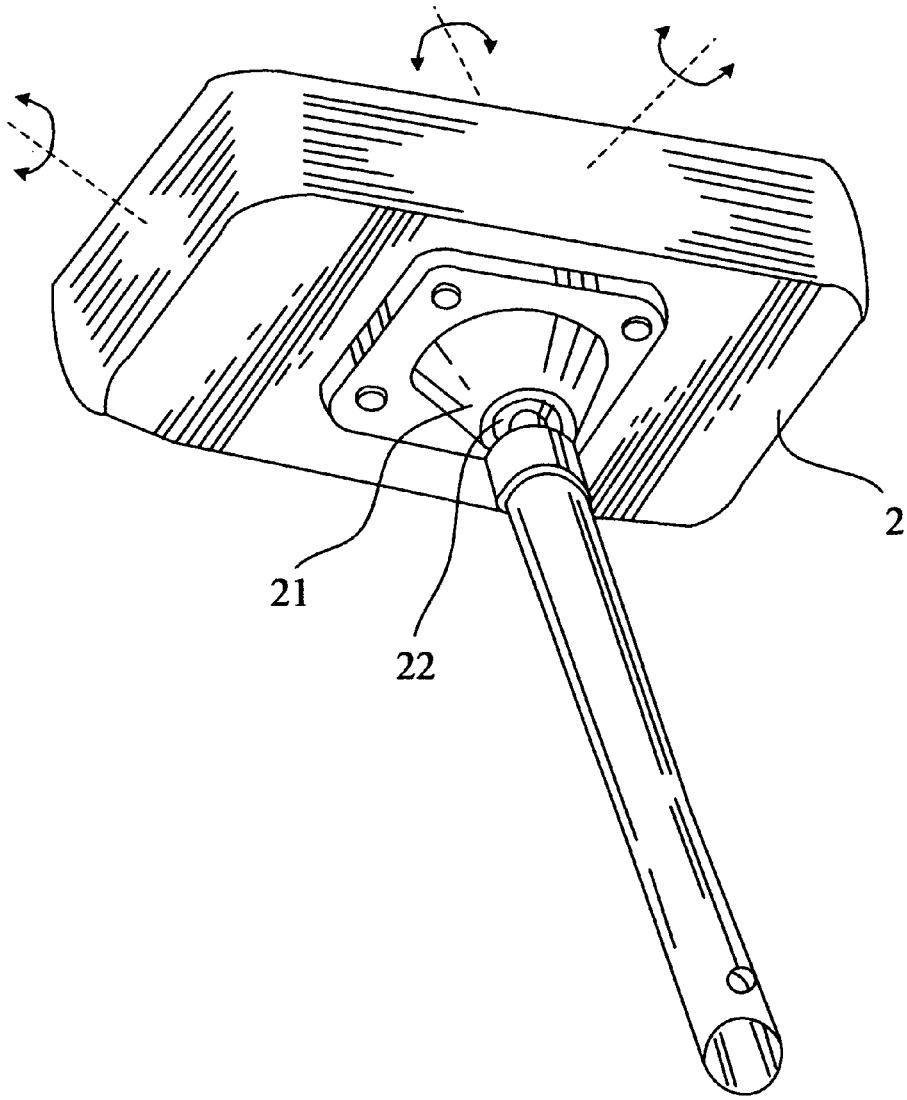
FIG. 4 is a perspective view of an omni-directional swivel joint and platform in accordance with the inventive disclosures herein.

FIG. 4 depicts the omni-directional tilt swivel member secured to the bottom of the platform member 2 in accordance with at least one embodiment of the inventive disclosures presented herein. In the depicted embodiment, the swivel member comprises a first omni-directional tilt swivel member 21, in the depicted embodiment a ball retentive socket secured to a bottom surface of the platform member, and a second omni directional tilt swivel member 22 secured to the top portion of the telescopic height adjustment member. In the particular embodiment depicted in FIG. 4, the second omni directional tilt swivel member comprises a ball. The second tilt and swivel member is sized and configured to rotationally and retentively engage the first tilt and swivel member allowing the platform member to rotate and tilt relative to the height adjustment member. Other types of omni-directional tilt swivel coupling members as would be known to those skilled in the art may be substituted without deviating from the design intent of this inventive disclosure presented herein.

In a preferred embodiment, the height adjustment member is constructed of telescoping steel tubular shapes. The platform member is constructed of aluminum or steel, and the padded cushion comprises a soft rubber interior portion covered with a washable and durable formed vinyl or similar cover. The base is aluminum or steel. In a preferred embodiment the platform member has a width of 5 to 8 inches, and a length of about 12 inches. The padded cushion has a thickness of between 1 to 3 inches. By varying the lengths of the tubular height adjustment members the upper body support tool is envisioned to have an adjustable height range of 6 inches to 60 inches, in various embodiments.

The discussed construction, illustrations and sequence of operation is for one embodiment of the invention, but is in no way limiting to other embodiments. The materials of construction and operating modes may be changed and enhanced without deviating from the intention of this inventive disclosure. For example, it is envisioned and intended to provide for the construction of the bases and telescopic height adjustment members from materials other than steel and aluminum, specifically materials which are known to be lighter and stronger and therefore advantageous in this application. The use of such alternate materials is envisioned as within the scope of this inventive disclosure. The use of lighter and stronger alternatives to steel and aluminum as would be known to one skilled in the art is intended and envisioned by the inventor to be advantageously applied within the scope of this disclosure.

In the preceding detailed description, reference has been made to the accompanying drawings that form a part hereof, and in which are shown by way of illustration specific embodiments in which the invention may be practiced. These embodiments and certain variants thereof have been described in sufficient detail to enable those skilled in the art to practice the invention. It is to be understood that other suitable embodiments may be utilized and that logical, material, mechanical, software and electrical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A device for providing support to the human upper body when having to lean over to work, comprising:

a platform member for supporting the human upper body in a leaning position thereby reducing back muscle strain and fatigue;

a cushioned pad secured to an upper surface of the platform member providing a cushioned interface between the human upper body and the platform;

an first omni-directional tilt and swivel member secured to a bottom surface of the platform member;

an elongated telescopic height adjustment member having a top portion and a bottom portion, the height adjustment member comprising:

one or more releasable position fixing pins wherein said fixing pins are comprised of latching pins extending through one or more holes in an elongated telescopic section;

a pin retainer key capable of preventing the latching key from becoming dislodged; and two or more elongated telescopic sections, each section having one or more pairs of holes, each section having a major axis, each hole in a pair facing alignment on opposing sides of the telescopic section such that each hole pair provides a hole completely through the telescopic section, the hole pairs spaced at intervals along the major axis of the telescopic section, the telescopic sections sized to be telescopically, slidably and supportively engaged with adjacent telescopic section, the holes in the adjacent telescopic sections sized and positioned so that as one section is telescopically adjusted relative to the adjacent section at least one pair of holes in the sections axially align at one or more telescopic positions so as to receive the releasable pin through the aligned holes, the pin supportively fixing the relative telescopic position of the sections, the pin being releasable so as to allow for further telescopic height adjustment, said sections being separable from one another so that sections may be removed or added as desired;

a section omni-directional tilt and swivel member secured to the top portion of the telescopic height adjustment member, the second tilt and swivel member sized and configured to rotationally and retentively engage the first tilt and swivel member allowing the platform member to positionally rotate and tilt relative to the height adjustment member; and one or more removable base members, the base member being removable to permit replacing the base member so as to accommodate base member configured for different floor or support conditions, the base member further comprising:

a swivel member secured to an upper surface of the base member, the swivel member sized and configured to supportively and removably receive the bottom portion of the height adjustment member, the base member to be replaced by another base member, the swivel member configured to permit the height adjustment member to rotate relative to the base; and a floor interface support means secured to the base member, the interface support means configured and adapted to provide support on one or more compositions of floor.

2. The device for providing support to the human upper body of claim 1 wherein the base swivel member is a socket assembly, the socket assembly comprising:

a socket secured to the base member;

a shaft member secured to the bottom portion of the height adjustment member, the shaft member sized and configured to be rotationally and supportively received into the socket, the socket assembly allowing the height adjustment member to rotate about the major axis relative to the base member, the socket assembly supportively preventing the height adjustment member from angularly tilting relative to the base member.

3. The device for providing support to the human upper body of claim 2 wherein the floor interface support means comprises a flat rectangular base configured to stable and supportively interface with a smooth floor.

4. The device for providing support to the human upper body of claim 2 wherein the floor interface support means comprise a tripod style base having three or more legs supportively interfacing with ground, the tripod legs angled outwards at the lower end so as to increase the stability of the base against tipping over.

5. The device for providing support to the human upper body of claim 2 wherein the floor interface member comprises an inverted U-shaped clamp for clamping to a vehicle frame or drive component.

6. The device for providing support to the human upper body of claim 2 wherein the first omni-directional tilt and swivel member further comprises a means to lock the position of the first and second omni-directional tilt swivel members.

7. The device for providing support to the human upper body of claim 6 wherein the first omni-directional tilt swivel member comprises a ball retentive socket; and wherein the second omni-directional tilt swivel member comprises a ball, the ball sized and configured to be retained within the socket.

* * * * *